US007375504B2

(12) United States Patent
Mheen et al.

(10) Patent No.: US 7,375,504 B2
(45) Date of Patent: May 20, 2008

(54) REFERENCE CURRENT GENERATOR

(75) Inventors: Bong Ki Mheen, Daejeon (KR); Min Hyung Cho, Daejeon (KR); Chong Ki Kwon, Daejeon (KR); Jin Yeong Kang, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 162 days.

(21) Appl. No.: 11/299,188

(22) Filed: Dec. 9, 2005

(65) Prior Publication Data

US 2006/0125460 A1 Jun. 15, 2006

(30) Foreign Application Priority Data

Dec. 10, 2004 (KR) ..... 10-2004-0104300
Aug. 2, 2005 (KR) ..... 10-2005-0070624

(51) Int. Cl.
*G05F 3/16* (2006.01)

(52) U.S. Cl. ..... 323/315; 323/313; 323/314; 323/316

(58) Field of Classification Search ..... 323/314, 323/315, 316
See application file for complete search history.

(56) References Cited

U.S. PATENT DOCUMENTS 5,266,885 A * 11/1993 Brambilla et al. ..... 323/313
6,501,299 B2 12/2002 Kim et al.
2003/0001554 A1* 1/2003 Park ..... 323/315
2003/0067291 A1* 4/2003 Hong ..... 323/315

FOREIGN PATENT DOCUMENTS

KR 10 0328452 11/2000
KR 10 0400304 7/2002
KR 10 0353289 9/2002
KR 10-2004 0004023 1/2004

OTHER PUBLICATIONS

Hironori Banba et al, "A CMOS Bandgap Reference Circuit with Sub-1-V Operation," IEEE Journal of Solid-State Circuits, vol. 34, No. 5, May 1999, pp. 670-674.

* cited by examiner

*Primary Examiner*—Matthew V Nguyen
*Assistant Examiner*—Nguyen Tran
(74) *Attorney, Agent, or Firm*—Ladas & Parry LLP

(57) ABSTRACT

Provided is a low-reference-current generator that includes a circuit employing two feedback loops enabling it to operate even at a low voltage, has a high power supply rejection ratio (PSRR) to control power supply noise, and simply forms a voltage without a voltage-to-current converter used in a conventional general reference current generator. The reference current generator includes: a first voltage generator receiving a predetermined current and generating a first voltage that decreases as temperature increases; a second voltage generator generating a second voltage that increases as temperature increases; a first current generator generating a first current corresponding to the first voltage; a second current generator generating a second current corresponding to the second voltage; and a reference current generator receiving the first current and the second current and generating a reference current that is the sum of the first current and the second current.

16 Claims, 4 Drawing Sheets

REFERENCE CURRENT GENERATOR

CROSS-REFERENCE TO RELATED APPLICATION

This application claims priority to and the benefit of Korean Patent Application No. 2004-104300, filed Dec. 10, 2004, and Korean Patent Application No. 2005-70624, filed Aug. 2, 2005, the disclosures of which are incorporated herein by reference in their entirety.

BACKGROUND

1. Field of the Invention

The present invention relates to a reference current generator, and more particularly, to a reference current generator that sums up current sources having different temperature characteristics from each other at one node and generates a reference current.

2. Discussion of Related Art

In an integrated circuit (IC), a reference voltage and a reference current are used during an analog operation of an analog-to-digital converter and so forth, and are essential for reducing circuit variation resulting from process variation and helping the circuit to stably operate even within a wide temperature variation range. A typical example of a conventional reference voltage generation method uses a voltage of a diode (or only one junction of a transistor) biased at a uniform current, and a voltage $V_T$ of a thermal voltage generator.

FIG. 1 is a circuit diagram of a conventional reference voltage generator. Referring to FIG. 1, the reference voltage generator comprises a voltage generator 10 including a voltage source that is proportional to temperature and another voltage source that is inversely proportional to temperature, a voltage former 20 forming a uniform voltage level using the voltage generated by the voltage generator 10, and a voltage output 30 connected to the voltage former 20 and outputting a voltage corresponding to the voltage formed by the voltage former 20.

The voltage generator 10 receives a first power supply Vcc and a second power supply Vss, and includes a first line and a second line. The first line includes a first transistor T1, a second transistor T2, a third transistor T3, and a fourth transistor T4 connected in series between the first power supply Vcc and the second power supply Vss, and the second line is connected between the first power supply Vcc and the second power supply Vss like the mirror image of the first line, and includes a fifth transistor T5, a sixth transistor T6, a seventh transistor T7, and an eighth transistor T8 connected in series to one another. The first line is connected to the second power supply Vss through a first bipolar junction transistor Q1, and the second line is connected to the second power supply Vss through a resistor R11 and a second bipolar junction transistor Q2. The first and second bipolar junction transistors Q1 and Q2 are diode-connected. The first, second, fifth, and sixth transistors T1, T2, T5, and T6 are P-channel metal oxide semiconductor (PMOS) transistors, and the third, fourth, seventh, and eighth transistors T3, T4, T7, and T8 are N-channel metal oxide semiconductor (NMOS) transistors.

Gates of the first and second transistors T1 and T2 are connected to gates of the fifth and sixth transistors T5 and T6 respectively in the mirror configuration, and gates of the third and fourth transistors T3 and T4 are connected to gates of the seventh and eighth transistors T7 and T8 respectively in the mirror configuration. The third, fourth, fifth, and sixth transistors T3, T4, T5, and T6 are diode-connected.

When the fifth and sixth transistors T5 and T6 are turned on, since the first and second transistors T1 and T2 are connected to the fifth and sixth transistors T5 and T6 in the mirror configuration, the same current that flows through the fifth and sixth transistors T5 and T6 flows through the first and second transistors T1 and T2. When the first and second transistors T1 and T2 are turned on, the third and fourth transistors T3 and T4 are turned on so that the same current that flows through the third and fourth transistors T3 and T4 flows through the seventh and eighth transistors T7 and T8. Therefore, a first current I1 and a second current I2 of equal magnitude flow through the first line and the second line, respectively, due to mutual current mirror operation.

Here, when the first current I1 flows through the first bipolar transistor Q1 to the second power supply Vss, a temperature around the first bipolar transistor Q1 goes up so that a voltage corresponding to the first current I1 decreases due to semiconductor characteristics of the first bipolar transistor Q1.

When the second current I2 flows through the first resistor R11 and the second bipolar transistor Q2 to the second power supply Vss, a predetermined voltage drop occurs across the first resistor R11.

The voltage drop across the first resistor R11 is described below. Since voltage levels of sources of the fourth and eighth transistors T4 and T8 are the same, voltages applied to the first and second bipolar junction transistors Q1 and Q2 and the first resistor R11 are as shown in Formula 1 according to Kirchhoff's voltage law:

$$Vq1-Vq2-V_{R11}=0 \qquad \text{Formula1}$$

Here, Vq1 denotes a voltage across the first bipolar junction transistor Q1, Vq2 denotes a voltage across the second bipolar junction transistor Q2, and $V_{R11}$ denotes a voltage across the first resistor R11.

Since the bipolar junction transistors are diode-connected, voltages formed at the bipolar junction transistors are as shown in Formula 2:

$$Vq=V_T \ln(Id/Is) \qquad \text{Formula2}$$

Here, Is denotes a saturated current as a constant, and Id denotes a current flowing through the bipolar junction transistors.

When Formula 2 is inserted into Formula 1, the voltage across the first resistor R11 is given by Formula 3:

$$V_{R11}=V_T \ln(N) \qquad \text{Formula3}$$

Here, $V_{R11}$ denotes the voltage of the first resistor R11, and $V_T$ denotes a thermal voltage (kT/q), which is proportional to temperature and is about 25.6 mV at normal temperature. N denotes a size ratio of the first and second bipolar junction transistors Q1 and Q2.

Referring to Formula 3, the size ratio of the first and second bipolar junction transistors Q1 and Q2 is adjusted by the voltage applied to the first resistor R11 so that the voltage across the first resistor R11 generated by the second current I2 can be adjusted. However, the voltage of the first resistor R11 is proportional to temperature as shown in Formula 3.

The voltage former 20 includes a third line that is supplied with power from the first power supply Vcc and the second power supply Vss, and has a ninth transistor T9 and a tenth transistor T10 connected in series to each other. In the third line, a third bipolar junction transistor Q3 and a second resistor R12 are connected between the tenth transistor T10 and the second power supply Vss. The third bipolar junction transistor Q3 is diode-connected. Also, a first node N1 that is connected to the voltage output 30 is formed between the tenth transistor T10 and the diode-connected third bipolar junction transistor Q3.

The ninth and tenth transistors T9 and T10 are PMOS transistors. Gates of the ninth and tenth transistors T9 and T10 are connected to the gates of the fifth and sixth transistors T5 and T6 respectively in the mirror configuration so that a third current I3 of the same magnitude as the current flowing through the fifth and sixth transistors T5 and T6 flows through the ninth and tenth transistors T9 and T11.

Here, the third current I3 flows through the second resistor R12 and the diode-connected third bipolar junction transistor Q3 to the second power supply Vss, the second resistor R12 mirrors the voltage of the first resistor R11 in the second line, and the third bipolar junction transistor Q3 closely mirrors the voltage applied to the first bipolar junction transistor Q1 in the first line.

Therefore, the resulting voltage across the second resistor R12 is increased by the surrounding temperature as shown in Formula 1, and the voltage across the third bipolar junction transistor Q3 is decreased by the surrounding temperature like the first bipolar junction transistor Q1. When the voltage decrease and increase perfectly offset each other, voltage variation according to temperature can be reduced.

The method described above is considered to be an effective method of reducing deviation of reference voltage and reference current in response to variation of temperature and process in an IC, and thus widely used. When deviation according to temperature characteristics of general PN junction and temperature of $V_T$ are designed to offset one another, a reference voltage of the method has a value of about 1.26 V corresponding to the bandgap of silicon, and thus called a bandgap reference voltage.

In an IC device, a metal-oxide semiconductor field-effect transistor (MOSFET) device has been continuously scaled down in order to improve operating speed, and thus a gate length of the MOSFET device reached 130 μm. Therefore, characteristics of the device are considerably improved, and a power supply voltage has been reduced to 1.2 V so that power consumption can be largely reduced. However, the power supply voltage of 1.2 V is lower than a conventional general reference voltage of 1.26 V. In addition, considering a margin of an operating point of a transistor to output a reference voltage, it is generally essential that the reference power supply voltage decreases to 1.0 V or below. However, with a conventional bandgap reference voltage generator, it is hard to reduce the reference voltage as described above.

In addition, reduction of operating voltage due to scaling of devices causes a signal-to-noise ratio (SNR) of a signal to decrease. This is because noise does not largely decrease compared to an actual signal interval, but rather increases due to a high operating speed and so forth. Due to this effect, a louder noise source exists in a power supply line that supplies power to a circuit, and in result, output noise of the reference voltage generator also increases.

SUMMARY OF THE INVENTION

The present invention is directed to a reference current generator that includes a circuit employing two feedback loops enabling it to operate even at a low voltage, has a high power supply rejection ratio (PSRR) to control power supply noise, and simply forms a voltage without a voltage-to-current converter used in a conventional general reference current generator.

One aspect of the present invention provides a reference current generator comprising: a first voltage generator receiving a predetermined current and generating a first voltage that decreases as temperature increases; a second voltage generator generating a second voltage that increases as temperature increases; a first current generator generating a first current corresponding to the first voltage; a second current generator generating a second current corresponding to the second voltage; and a reference current generator receiving the first current and the second current and generating a reference current that is the sum of the first current and the second current.

Another aspect of the present invention provides a reference current generator comprising: a first current generator receiving a predetermined current and generating a first current that decreases as temperature increases; a second current generator receiving a predetermined current and generating a second current that increases as temperature increases; and a reference current generator summing up the first current and the second current to generate a third current.

BRIEF DESCRIPTION OF THE DRAWINGS

The above and other features and advantages of the present invention will become more apparent to those of ordinary skill in the art by describing in detail preferred exemplary embodiments thereof with reference to the attached drawings in which.

DETAILED DESCRIPTION OF EXEMPLARY EMBODIMENTS

Hereinafter, an exemplary embodiment of the present invention will be described in detail. However, the present invention is not limited to the exemplary embodiments disclosed below, but can be implemented in various types. Therefore, the present exemplary embodiment is provided for complete disclosure of the present invention and to fully inform the scope of the present invention to those of ordinary skill in the art.

Figure 1:
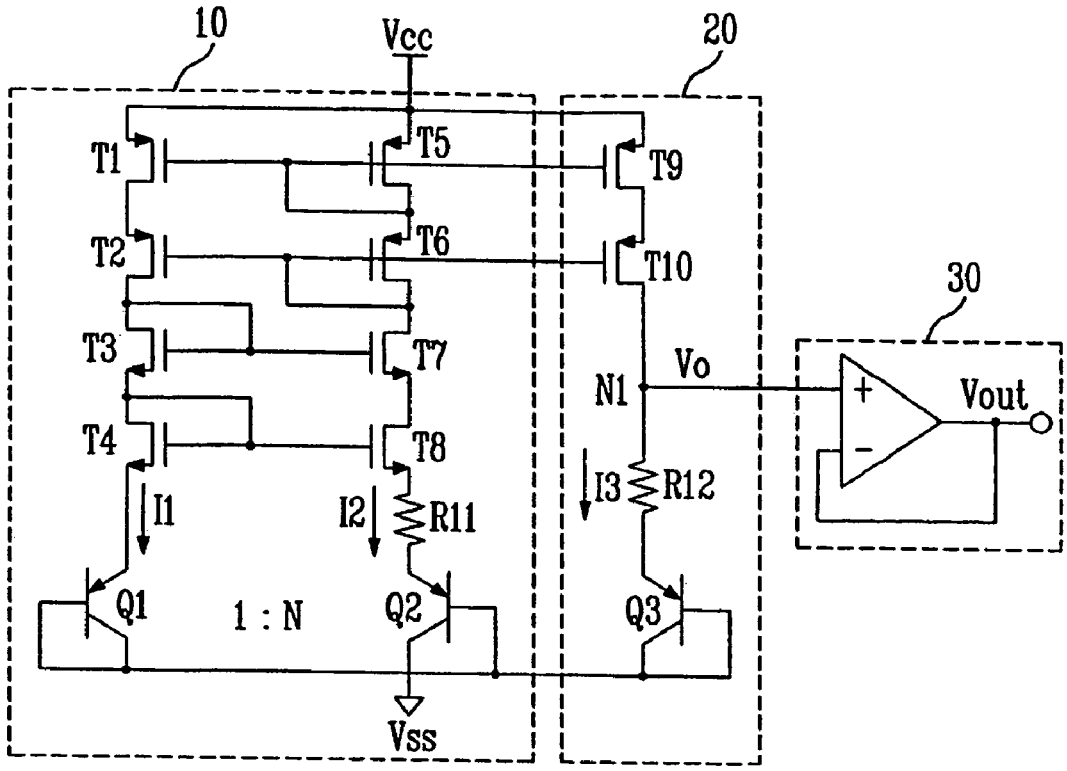
FIG. 1 (PRIOR ART)
FIG. 1 is a circuit diagram of a conventional reference voltage generator.
Figure 2:
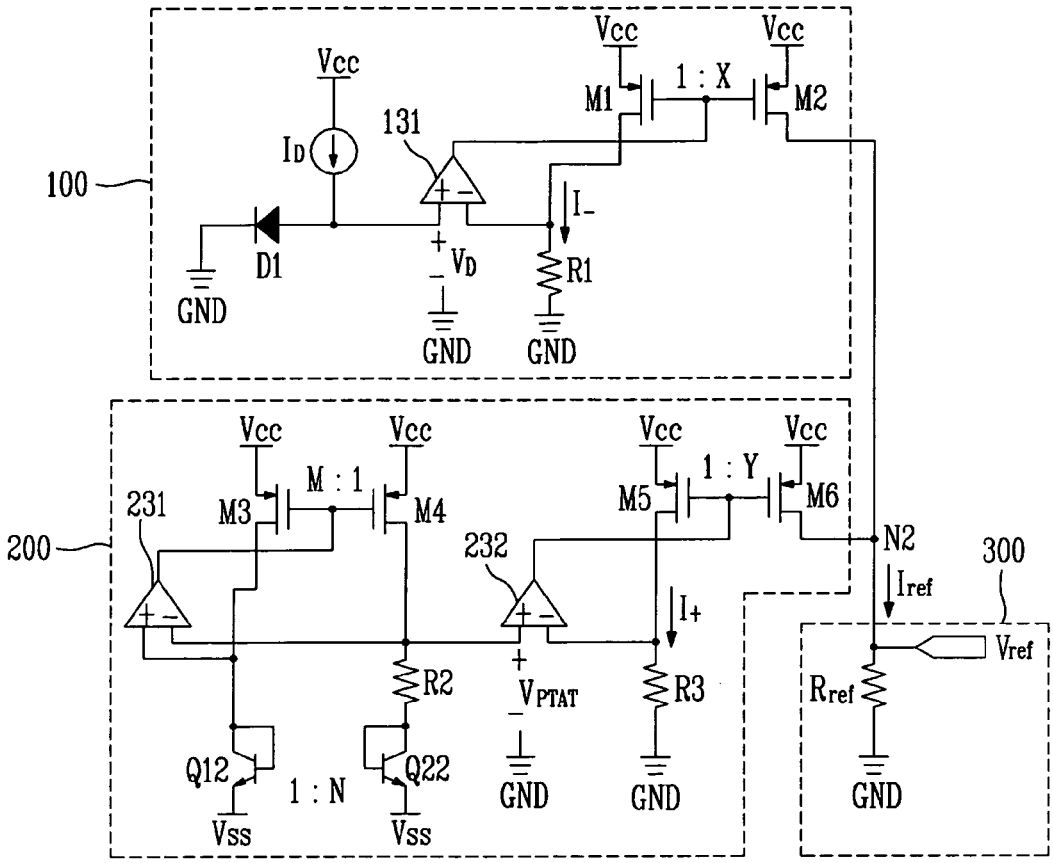
FIG. 2 is a circuit diagram of a first exemplary embodiment of a reference current generator according to the present invention.

FIG. 2 is a conceptual circuit diagram of a reference current generator according to the present invention. Referring to FIG. 2, the reference current generator comprises a first current generator 100, a second current generator 200, and a first reference voltage generator 300. According to an increase in temperature, the first current generator 100 reduces a current, and the second current generator 200 increases a current. The reference current generator sums the currents formed by the first and second current generators 100 and 200, and thus generates a uniform current. The first reference voltage generator 300 generates a predetermined voltage using the sum of currents formed by the first and second current generators 100 and 200.

The first current generator 100 includes a first diode D1, a current source $I_D$, a first amplifier 131, a first transistor M1, and a second transistor M2. When the current source $I_D$ allows a forward current to flow, a predetermined voltage is formed across the first diode D1 due to diode characteristics irrespective of the uniform current flowing through the first diode. Here, the predetermined voltage that is formed across the first diode D1 varies according to temperature, and decreases when the surrounding temperature increases.

The first amplifier 131 is supplied with two input voltages and adjusts one output voltage level. In addition, the first diode D1 is connected to one input terminal of the first amplifier 131, and a first resistor R1 through which a predetermined current flows is connected to the other input terminal. Therefore, the voltage formed across the first diode D1 is applied to the former input terminal, and a voltage of the first resistor R1 is applied to the latter input terminal. Hence, as the temperature increases, the voltage across the first diode D1 decreases so that the voltage output from the first amplifier 131 decreases. In addition, the first amplifier 131 is an inverted amplifier, and thus has a negative voltage level. As a result, a voltage that is added to the first resistor R1 by feedback becomes the same as the voltage of the first diode D1.

Gates of the first and second transistors M1 and M2 are connected to each other in the mirror configuration. In addition, the gates are connected to an output terminal of the first amplifier 131 so that a predetermined current flows through the first and second transistors M1 and M2 according to the output voltage of the first amplifier 131, and a current corresponding to a ratio of the first transistor M1 and the second transistor M2 flows through the second transistor M2. Here, the current flowing through the first transistor M1 flows through the first resistor R1 and thus allows a predetermined voltage to be applied to the first amplifier 131. In addition, magnitudes of the currents flowing through the first and second transistors M1 and M2 are determined according to the output voltage of the first amplifier 131, and the first amplifier 131 outputs a voltage that decreases as temperature is increased by the first diode D1. Therefore, the magnitudes of the currents flowing through the first and second transistors M1 and M2 decrease as the temperature increases. And, the current flowing through the second transistor M2 flows through a second node N2.

The second current generator 200 includes a third transistor M3, a fourth transistor M4, a fifth transistor M5, a sixth transistor M6, a second amplifier 231, a third amplifier 232, a second resistor R2, a first bipolar junction transistor Q12, and a second bipolar junction transistor Q22. The third and fourth transistors M3 and M4 are connected so as to mirror each other, and gates thereof are connected to an output terminal of the second amplifier 231. Therefore, currents flowing through the third and fourth transistors M3 and M4 are determined according to an output voltage of the second amplifier 231. In addition, the first and second bipolar junction transistors Q12 and Q22 are diode-connected.

The output terminal of the second amplifier 231 is connected to the gates of the third and fourth transistors M3 and M4. One input terminal of the second amplifier 231 is connected in parallel to the third transistor M3 and the first bipolar junction transistor Q12, the other input terminal is connected in parallel to the fourth transistor M4, and the second resistor R2 and the second bipolar junction transistor Q22 connected in series. Therefore, the former input terminal is supplied with a voltage formed by the current flowing through the third transistor M3 at the second bipolar junction transistor Q12, and the latter input terminal is supplied with a voltage across the second resistor R2 and the second bipolar junction transistor Q22. Here, the voltage across the second resistor R2 and the second bipolar junction transistor Q22 corresponds to Formula 3 above and increases according to increase in temperature.

The fifth and sixth transistors M5 and M6 are connected so as to mirror each other and thus gates thereof are connected to each other. The gates of the fifth and sixth transistors M5 and M6 are connected to an output terminal of the third amplifier 232. Therefore, currents according to an output voltage of the third amplifier 232 flow through the fifth and sixth transistors M5 and M6, and a ratio of the currents flowing through the fifth and sixth transistors M5 and M6 is determined according to sizes of the fifth and sixth transistors M5 and M6. In addition, one input terminal of the third amplifier 232 is connected to the second resistor R2, and thus the voltage level increases as temperature increases so that the output voltage of the third amplifier 232 increases according to increase in temperature. Therefore, the currents flowing through the fifth and sixth transistors M5 and M6 increase as the temperature increases. And, the current flowing through the sixth transistor M6 is supplied to the second node N2, and thus added to the current flowing through the second transistor M2.

Here, sizes of the first and second transistors M1 and M2 and the fifth and sixth transistors M5 and M6 are adjusted, and thus the magnitudes of currents flowing through the second and sixth transistors M2 and M6 are adjusted so that a current sum at the second node N2 remains constant irrespective of a change in temperature.

The first reference voltage generator 300 includes a reference resistor Rref, and supplies the reference resistor Rref with a uniform voltage irrespective of change in temperature using the current flowing through the second node N2 as a source current.

Figure 3:
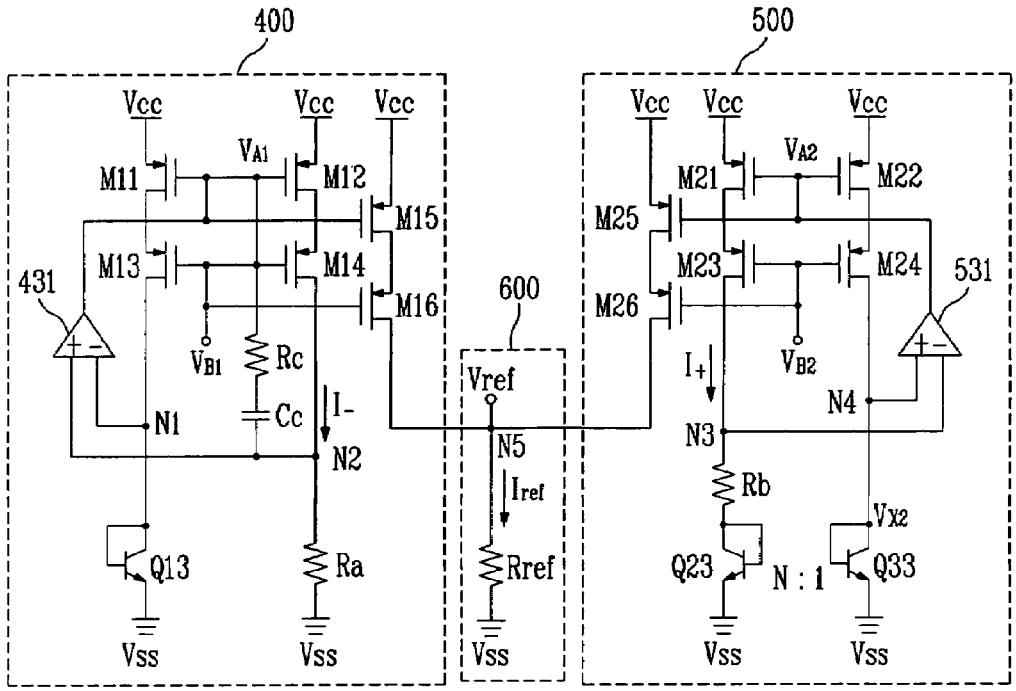
FIG. 3 is a circuit diagram of a second exemplary embodiment of a reference current generator according to the present invention.

FIG. 3 is a circuit diagram of a second exemplary embodiment of a reference current generator according to the present invention. Referring to FIG. 3, the reference current generator comprises a third current generator 400, a fourth current generator 500, and a second reference voltage generator 600. As temperature increases, the third current generator 400 decreases a current and the fourth current generator 500 increases a current. The reference current generator sums up the currents generated by the third and fourth current generators 400 and 500 to form a uniform current. The second reference voltage generator 600 generates a predetermined voltage using the uniform current resulting from summing the currents formed by the third and fourth current generators 400 and 500.

The third current generator 400 includes a first transistor M11, a second transistor M12, a third transistor M13, a fourth transistor M14, a fifth transistor M15, a sixth transistor M16, a first amplifier 431, a first bipolar junction transistor Q13, a first resistor Ra, a third resistor Rc, and a capacitor Cc. The fourth current generator 500 includes a seventh transistor M21, an eighth transistor M22, a ninth transistor M23, a tenth transistor M24, an eleventh transistor M25, a twelfth transistor M26, a second amplifier 531, a second bipolar junction transistor Q23, a third bipolar junction transistor Q33, and a second resistor Rb.

The first and second transistors M11 and M12 and the fifth transistor M15, the third and fourth transistors M13 and M14 and the sixth transistor M16, the seventh and eighth transistors M21 and M22 and the eleventh transistor M25, and the ninth and tenth transistors M23 and M24 and the twelfth transistor M26 are connected to mirror each other, respectively. And the first, second, and third bipolar junction transistors Q13, Q23, and Q33 are diode-connected.

The first bipolar junction transistor Q13 is connected to a drain of the third transistor M13 through a first node N1. The first resistor Ra is connected to a drain of the fourth transistor M4 through a second node N2. The second resistor Rb and the second bipolar junction transistor Q23 are connected in series to a drain of the ninth transistor M23 through a third node N3. The third bipolar junction transistor Q33 is connected to a drain of the tenth transistor M24 through a fourth node N4.

Gates of the first, second, and fifth transistors M11, M12, and M15 are connected to an output terminal of the first amplifier 431. A voltage of the first node N1 is supplied to one input terminal of the first amplifier 431, and a voltage of the second node N2 is supplied to the other input terminal.

Gates of the seventh, eighth, and eleventh transistors M21, M22, and M25 are connected to an output terminal of the second amplifier 531. A voltage of the third node N3 is supplied to one input terminal of the second amplifier 531, and a voltage of the fourth node N4 is supplied to the other input terminal.

The fifth transistor M15 is connected to the gates of the first and second transistors M11 and M12, and thus supplies a current corresponding to a current flowing through the second transistor M12 to the sixth transistor M16. The sixth transistor M16 is connected to gates of the third and fourth transistors M13 and M14, and to a reference resistor Rref through a fifth node N5.

The eleventh transistor M25 is connected to the gates of the seventh and eighth transistors M21 and M22, and thus supplies a current corresponding to a current flowing through the seventh transistor M21 to the twelfth transistor M26. The twelfth transistor M26 is connected to gates of the ninth and tenth transistors M23 and M24, and to the reference resistor Rref through the fifth node N5.

Operation of the reference current generator will be now described below. First, a voltage allows the first, second, and fifth transistors M11, M12, and M15 to generate predetermined currents, supplied from the output terminal of the first amplifier 431 to the gates of the transistors M11, M12, and M15. And, the third, fourth, and sixth transistors M13, M14, and M16 are turned on by the voltage applied to gates thereof, and thus allow the currents formed by the first, second, and fifth transistors M11, M12, and M15 to flow. The current formed by the first transistor M11 is supplied to the first bipolar junction transistor Q13, and the first bipolar junction transistor Q13 is connected in a forward bias direction and thus has a predetermined voltage level. Here, the level of the voltage across the first bipolar junction transistor Q13 decreases when a surrounding temperature increases.

Therefore, when the surrounding temperature increases, the voltage of the first node N1 decreases, and thus the first, second, and fifth transistors M11, M12, and M15 allow less current to flow. In addition, since the second node N2 has a voltage applied to the first resistor Ra by a current flowing through the fourth transistor M14, the first amplifier 431 is supplied with a predetermined voltage by the current generated by the output terminal of the first amplifier 431. In result, an output voltage of the first amplifier 431 is adjusted by the current flowing through the output terminal of the first amplifier 431.

Therefore, the fifth node N5 that is connected to the fifth and sixth transistors M15 and M16 is supplied with the current that decreases when temperature increases.

In addition, a voltage supplied from the output terminal of the second amplifier 531 to the gates of the seventh, eighth, and eleventh transistors M21, M22, and M25 enables the transistors M21, M22, and M25 to generate predetermined currents. And, the ninth, tenth, and twelfth transistors M23, M24, and M26 are turned on by the voltage applied to gates thereof, and thus allow the currents formed by the seventh, eighth, and eleventh transistors M21, M22, and M25 to flow. The current formed by the seventh transistor M21 is supplied to the third node N3, and the current formed by the eighth transistor M22 is supplied to the fourth node N4. Here, a voltage is formed at the third node N3 according to Formula 3 described above, and thus increases when a surrounding temperature increases. Since the voltage of the third node N3 that is input to the second amplifier 531 increases, the seventh, eighth, and eleventh transistors M21, M22, and M25 allow larger currents to flow. Hence, the fifth node N5 is supplied with a current that increases when the surrounding temperature increases.

Therefore, the currents flowing through the fifth and eleventh transistors Ml5 and M25 are summed up and become a current Iref that is independent of temperature, the current Iref flowing through the fifth node N5. And, the current Iref that flows through the fifth node N5 is supplied to the reference resistor Rref so that a uniform voltage which is temperature invariant is formed across the reference resistor Rref.

The third resistor Rc and the capacitor Cc are connected in series to the gates of the first, second, and fifth transistors M11, M12, and M15. The first resistor Ra that passes a current by a diode voltage is driven by one cascade current mirror circuit. The cascade current mirror circuit is driven by a differential-input single-output amplifier. A high loop gain by the amplifier and cascade current mirror is not guaranteed to be stabilized by only the third resistor Rc, and thus is compensated by the structure having the third resistor Rc and the capacitor Cc connected in series. In order to sufficiently separate a power supply line and a signal line, a high power supply rejection ratio (PSRR) is required, and thus a high loop gain is needed.

Figure 4:
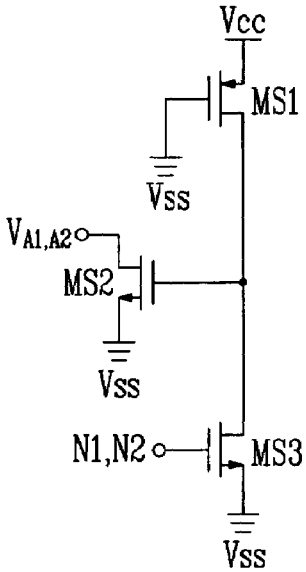
FIG. 4 is a circuit diagram of an initial driving circuit applied to the reference current generator shown in FIG. 3.

FIG. 4 is a circuit diagram of an initial driving circuit applied to the reference current generator shown in FIG. 3. Referring to FIG. 4, the initial driving circuit includes a thirteenth transistor MS1, a fourteenth transistor MS2, and a fifteenth transistor MS3. As for the thirteenth transistor MS1, a source is connected to a first power supply Vcc, a drain is connected to a gate of the fourteenth transistor MS2, and a gate is connected to a second power supply Vss. As for the fourteenth transistor MS2, a drain is connected to a predetermined terminal, a source is connected to the second power supply Vss, and the gate is connected to the drain of the thirteenth transistor MS1 and a drain of the fifteenth transistor MS3. As for the fifteenth transistor MS3, a drain is connected to the gate of the fourteenth transistor MS2, a source is connected to the second power supply Vss, and a gate is connected to a predetermined terminal. The thirteenth transistor MS1 is a P-channel metal oxide semiconductor (PMOS) transistor, and thus is turned on by a low voltage. One the contrary, the fourteenth and fifteenth transistors MS2 and MS3 are N-channel metal oxide semiconductor (NMOS) transistors, and thus are turned on by a high voltage. In addition, the second power supply Vss denotes a ground terminal.

Operation of the initial driving circuit is described below. First, when a width-to-length ratio of the thirteenth transistor MS1 is reduced so that the thirteenth transistor MS1 has a large resistance, and the resistance is reduced below a resistance of the fifteenth transistor MS3 in an off-state, a voltage at the drain of the thirteenth transistor MS1 is maintained high. Therefore, a voltage at the gate of the fourteenth transistor MS2 gradually increases and thus the fourteenth transistor MS2 is turned on. When the fourteenth transistor MS2 is turned on, the drain thereof is grounded. Here, the drain of the fourteenth transistor MS2 is connected to the gates of the first and eighth transistors M11 and M22 shown in FIG. 3, and thus reduces voltage levels of the gates of the first and eighth transistors M11 and M22. Therefore, the first and eighth transistors M11 and M22 allow predetermined currents to flow, and the predetermined currents allow predetermined voltages to be applied to the first and fourth nodes N1 and N4 shown in FIG. 3. When the fifteenth transistor MS3 is turned on by the voltages of the first and fourth nodes N1 and N4 shown in FIG. 3, the gate voltage of the fourteenth transistor MS2 decreases again. With the method described above, initial driving is performed.

The initial driving circuit shown in FIG. 4 has been described in relation to FIG. 3, but can equally be applied to the reference current generator shown in FIG. 2.

Figure 5:
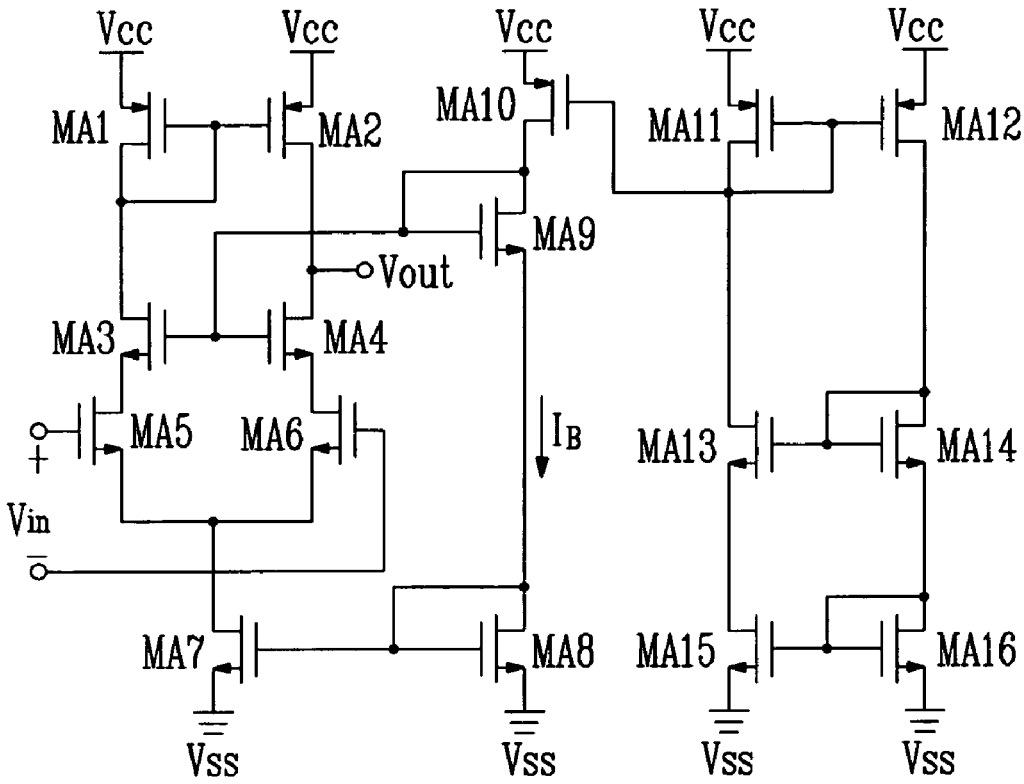
FIG. 5 is a circuit diagram of an example of amplifiers shown in FIGS. 2 and 3.

FIG. 5 is a circuit diagram of an example of amplifiers shown in FIGS. 2 and 3.

The reference current generators of the present invention can generate a reference current that can operate at a relatively low voltage because a reference power is formed by a current mode technique, have structures that can control noise existing in a power supply line, can reduce nonlinearity due to temperature dependence, and can be formed into a relatively simple circuit.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A reference current generator comprising: a first current generator receiving a predetermined current and generating a first current that increases as temperature increases; a second current generator receiving a predetermined current and generating a second current that decreases as temperature increases; and a reference current generator summing up the first current and the second current to generate a third current, wherein the first current generator comprises:

a first transistor and a second transistor connected so as to mirror each other and generating currents according to a predetermined voltage;

a third transistor and a fourth transistor connected so as to mirror each other and allowing the currents generated by the first transistor and the second transistor according to the predetermined voltage to flow;

a fifth transistor connected to the first transistor and the second transistor in the mirror configuration and allowing the first current corresponding to the currents generated by the first transistor and the second transistor to flow;

a sixth transistor connected to the third transistor and the fourth transistor in the mirror configuration and turned on together with the third transistor and the fourth transistor;

a first diode connected to the third transistor and generating a predetermined voltage by the predetermined current generated by the first transistor;

a first resistor connected to the fourth transistor and allowing the current flowing through the fourth transistor to flow; and a first amplifier adjusting a first voltage and a voltage across the first resistor by the first current, and adjusting voltages supplied to gates of the first transistor and the second transistor.

2. The reference current generator according to claim 1, wherein the first current generator is connected to a loop gain compensation circuit.

3. The reference current generator according to claim 2, wherein the loop gain compensation circuit includes a third resistor and a capacitor connected in series to each other, and is connected to the gates of the first transistor and the second transistor.

4. The reference current generator according to claim 1, wherein the second current generator includes:

a seventh transistor and an eighth transistor connected so as to mirror each other and generating currents according to a predetermined voltage;

a ninth transistor and a tenth transistor connected so as to mirror each other and allowing the currents generated by the seventh transistor and the eighth transistor according to the predetermined voltage to flow;

a voltage generator connected to the ninth transistor and the tenth transistor and generating a voltage in proportion to temperature;

an eleventh transistor connected to the seventh transistor and the eighth transistor in the mirror configuration and allowing a current corresponding to the currents generated by the seventh transistor and the eighth transistor to flow, and allowing a current corresponding to a current flowing through the voltage generator to flow; and a twelfth transistor connected to the ninth transistor and the tenth transistor in the mirror configuration, turned on together with the ninth transistor and the tenth transistor, and allowing the currents flowing through the eleventh transistor to flow.

5. The reference current generator according to claim 4, wherein the voltage generator includes:

a second resistor and a second diode connected in series to each other and receiving the current flowing through the ninth transistor;

a third diode receiving the current flowing through the tenth transistor; and a second amplifier receiving voltages applied to the second resistor and the third diode, applying a predetermined voltage to gates of the seventh transistor and the eighth transistor, and adjusting the voltages across the second resistor and the second diode and the voltage across the third diode.

6. The reference current generator according to claim 4, further comprising an initial driving circuit turning on the first transistor and the second transistor or the seventh transistor and the eighth transistor.

7. The reference current generator according to claim 6, wherein the initial driving circuit includes:

a thirteenth transistor having a source connected to a predetermined voltage source, a drain connected to a sixth node, and a gate connected to a ground terminal;

a fourteenth transistor having a source connected to a seventh node, a drain connected to a ground terminal, and a gate connected to the sixth node; and a fifteenth transistor having a source connected to the sixth node, a drain connected to a ground terminal, and a gate connected to an eighth node, the seventh node being connected to a gate of the first or seventh transistor, the eight node being connected to a first or fourth node.

8. The reference current generator according to claim 1, wherein the reference current generator is connected to a reference resistor and allows the reference resistor to generate a reference voltage.

9. A reference current generator comprising:

a first current generator receiving a predetermined current and generating a first current that decreases as temperature increases;

a second current generator receiving a predetermined current and generating a second current that increases as temperature increases; and a reference current generator summing up the first current and the second current to generate a third current wherein the second current generator comprises:

a seventh transistor and an eighth transistor connected so as to mirror each other and generating currents according to a predetermined voltage;

a ninth transistor and a tenth transistor connected so as to mirror each other and allowing the currents generated by the seventh transistor and the eighth transistor according to the predetermined voltage to flow;

a voltage generator connected to the ninth transistor and the tenth transistor and generating a voltage in proportion to temperature;

an eleventh transistor connected to the seventh transistor and the eighth transistor in the mirror configuration and allowing a current corresponding to the currents generated by the seventh transistor and the eighth transistor to flow, and allowing a current corresponding to a current flowing through the voltage generator to flow; and a twelfth transistor connected to the ninth transistor and the tenth transistor in the mirror configuration, turned on together with the ninth transistor and the tenth transistor, and allowing the currents flowing through the eleventh transistor to flow.

10. The reference current generator according to claim 9, wherein the voltage generator includes:

a second resistor and a second diode connected in series to each other and receiving the current flowing through the ninth transistor;

a third diode!receiving the current flowing through the tenth transistor; and a second amplifier receiving voltages applied to the second resistor and the third diode, applying a predetermined voltage to gates of the seventh transistor and the eighth transistor, and adjusting the voltages across the second resistor and the second diode and the voltage across the third diode.

11. The reference current generator according to claim 9, wherein the first current generator includes:

a first transistor and a second transistor connected so as to mirror each other and generating currents according to a predetermined voltage;

a third transistor and a fourth transistor connected so as to mirror each other and allowing the currents generated by the first transistor and the second transistor according to the predetermined voltage to flow;

a fifth transistor connected to the first transistor and the second transistor in the mirror configuration and allowing the first current corresponding to the currents generated by the first transistor and the second transistor to flow;

a sixth transistor connected to the third transistor and the fourth transistor in the mirror configuration and turned on together with the third transistor and the fourth transistor;

a first diode connected to the third transistor and generating a predetermined voltage by the predetermined current generated by the first transistor;

a first resistor connected to the fourth transistor and allowing the current flowing through the fourth transistor to flow; and a first amplifier adjusting a first voltage and a voltage across the first resistor by the first current, and adjusting voltages supplied to gates of the first transistor and the second transistor.

12. The reference current generator according to claim 11, wherein the first current generator is connected to a loop gain compensation circuit.

13. The reference current generator according to claim 12, wherein the loop gain compensation circuit includes a third resistor and a capacitor connected in series to each other, and is connected to the gates of the first transistor and the second transistor.

14. The reference current generator according to claim 11, further comprising an initial driving circuit turning on the first transistor and the second transistor and/or the seventh transistor and the eighth transistor.

15. The reference current generator according to claim 14, wherein the initial driving circuit includes:

a thirteenth transistor having a source connected to a predetermined voltage source, a drain connected to a sixth node, and a gate connected to aground terminal;

a fourteenth transistor having a source connected to a seventh node, a drain connected to a ground terminal, and a gate connected to the sixth node; and a fifteenth transistor having a source connected to the sixth node, a drain connected to a ground terminal, and a gate connected to an eighth node, the seventh node being connected to a gate of the first or seventh transistor, the eight node being connected to a first or fourth node.

16. The reference current generator according to claim 9, wherein the reference current generator is connected to a reference resistor and allows the reference resistor to generate a reference voltage.

* * * * *